US011315450B2

(12) United States Patent
Xi

(10) Patent No.: US 11,315,450 B2
(45) Date of Patent: Apr. 26, 2022

(54) INVERTER, GATE DRIVING ON ARRAY CIRCUIT AND RELATED DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventor: Suping Xi, Shenzhen (CN)

( * ) Notice: Subject to any disclaimer, the term of this patent is extended or adjusted under 35 U.S.C. 154(b) by 262 days.

(21) Appl. No.: 16/619,858

(22) PCT Filed: Oct. 31, 2019

(86) PCT No.: PCT/CN2019/114672

§ 371 (c)(1),
(2) Date: Dec. 5, 2019

(87) PCT Pub. No.: WO2021/051487

PCT Pub. Date: Mar. 25, 2021

(65) Prior Publication Data

US 2021/0335164 A1 Oct. 28, 2021

(30) Foreign Application Priority Data

Sep. 17, 2019 (CN) ..... 201910875189.1

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0408* (2013.01); *G09G 2300/0823* (2013.01); *G09G 2310/0267* (2013.01); *G09G 2330/12* (2013.01)

(58) Field of Classification Search
CPC .. G09G 3/006; G09G 3/20; G09G 2300/0408; G09G 2300/0823; G09G 2310/0267; G09G 2330/12; G09G 2300/0426
See application file for complete search history.

(56) References Cited

U.S. PATENT DOCUMENTS

2009/0152441 A1* 6/2009 Pak ..... G01J 1/46 250/214 DC
2011/0169793 A1* 7/2011 Chen ..... G09G 3/3677 345/87
2013/0335376 A1* 12/2013 Lee ..... G06F 3/0446 345/174
2014/0063366 A1* 3/2014 Zhang ..... G02B 30/27 349/12

(Continued)

*Primary Examiner* — Jose R Soto Lopez
(74) *Attorney, Agent, or Firm* — JMB Davis Ben-David

(57) ABSTRACT

An inverter, a gate driver on array circuit, and a display panel are provided. The inverter includes a first transistor, a second transistor, a third transistor, a fourth transistor, a first test transistor, a second test transistor, and a third test transistor. A gate and a source of the first transistor and a source of the third transistor are electrically connected to a first test signal line, a drain of the first transistor, a drain of the second transistor is electrically connected to a first node, a gate of the second transistor and a gate of the fourth transistor are electrically connected to the pull-up node, and a drain of the third transistor and a drain of the fourth transistor are electrically connected to a second node.

16 Claims, 2 Drawing Sheets

(56) References Cited

U.S. PATENT DOCUMENTS

| | | | | |
|---|---|---|---|---|
| 2016/0125828 | A1* | 5/2016 | Xiao | G09G 3/3677 345/98 |
| 2016/0125831 | A1* | 5/2016 | Xiao | G09G 3/3677 345/92 |
| 2016/0133473 | A1* | 5/2016 | Wang | H01L 21/28035 438/154 |
| 2016/0240158 | A1* | 8/2016 | Xu | G09G 3/3696 |
| 2016/0259455 | A1* | 9/2016 | Li | G06F 3/04164 |
| 2016/0307532 | A1* | 10/2016 | Dai | G09G 3/3406 |
| 2016/0343323 | A1* | 11/2016 | Xiao | G09G 3/3677 |
| 2016/0351109 | A1* | 12/2016 | Han | G11C 19/28 |
| 2016/0351152 | A1* | 12/2016 | Dai | H01L 29/7869 |
| 2017/0229081 | A1* | 8/2017 | Dai | G02F 1/1368 |
| 2017/0358266 | A1* | 12/2017 | Zhang | G09G 3/3677 |
| 2018/0211612 | A1* | 7/2018 | Hong | G02F 1/13306 |
| 2018/0218701 | A1* | 8/2018 | Yi | G11C 19/28 |
| 2019/0043437 | A1* | 2/2019 | Hao | G09G 3/3677 |
| 2019/0385533 | A1* | 12/2019 | Liu | G09G 3/3266 |
| 2020/0152151 | A1* | 5/2020 | Zhang | G09G 3/006 |
| 2021/0090481 | A1* | 3/2021 | Li | G09G 3/006 |

* cited by examiner

INVERTER, GATE DRIVING ON ARRAY CIRCUIT AND RELATED DISPLAY PANEL

CROSS-REFERENCE TO RELATED APPLICATIONS

This is the U.S. National Stage of International Patent Application No. PCT/CN2019/114672, filed Oct. 31, 2019, which in turn claims the benefit of Chinese Patent Application No. 201910875189.1, filed Sep. 17, 2019.

FIELD OF THE INVENTION

The present disclosure relates to the display field, and more particularly to an inverter, a gate driver on array (GOA) circuit and a display panel.

BACKGROUND

The gate driver on array (GOA) circuit is realized by implementing gate drivers on the array substrate through a conventional TFT matrix process. In order to ensure the output signal of the GOA circuit to have the right waveform, a pull-up node is required to maintain the voltage level of the output signal. Furthermore, the inverter in the GOA circuit needs to work normally such that the output signal at the pull-up node could be correct. However, as to the inverter, different size arrangements of the transistors would make the transistors have different workloads. In addition, if the size of the inverter is not appropriate, the threshold voltages of the transistors in the inverter seriously shift. In this way, when the inverter works for a long time, the electrical characteristics of the transistors may be ruined such that the inverter may not work normally. This also ruins the waveform of the output signal of the GOA circuit at the pull-up node.

Through the simulation, the waveforms of the output signal of the GOA circuit in different size arrangements of the transistors could be observed. However, the simulation is quite different from the real implementation and the simulation cannot provide an exact electrical characteristic curve of a transistor. This makes the simulation difficult to match the real implementation. In this situation, a designer often needs to make a test display panel and examine the stability of the display panel to know the performance of the circuit such that the designer could know which size arrangement is better. However, the inverters having different size arrangements need to be manufactured by multiple masks, which cost a lot. Therefore, a systematic examination is not often possible due to the cost.

SUMMARY

One objective of an embodiment of the present disclosure is to provide an inverter, a GOA circuit and a display panel to solve the above-mentioned issues.

According to an embodiment of the present disclosure, an inverter used in a gate driver on array (GOA) circuit is disclosed. The GOA circuit comprises a pull-up node. The inverter comprises a first transistor, a second transistor, a third transistor, a fourth transistor, a first test transistor, a second test transistor, and a third test transistor. A gate of the first transistor, a source of the first transistor and a source of the third transistor are electrically connected to a first test signal line. A drain of the first transistor, a drain of the second transistor, and a gate of the third transistor are electrically connected to a first node. A gate of the second transistor and a gate of the fourth transistor are electrically connected to the pull-up node. A source of the second transistor and a source of the fourth transistor are electrically connected to a constant low voltage signal. A drain of the third transistor and a drain of the fourth transistor are electrically connected to a second node. A gate of the first test transistor, a gate of the second test transistor and a gate of the third test transistor are electrically connected to the first node. A drain of the first test transistor, a drain of the second test transistor and a drain of the third test transistor are electrically connected to the second node. A source of the first test transistor is electrically connected to a second test signal line, a source of the second test transistor is electrically connected to a third test signal line, and a source of the third test transistor is electrically connected to a fourth test signal line.

Optionally, the first transistor, the second transistor, the third transistor, the fourth transistor, the first test transistor, the second test transistor, and the third test transistor are all low temperature poly-silicon (LTPS) thin film transistors (TFTs), oxide semiconductor TFTs, or amorphous TFTs.

Optionally, the first transistor, the second transistor, the third transistor, the fourth transistor, the first test transistor, the second test transistor, and the third test transistor are all a same type of transistors.

Optionally, the first transistor, the second transistor, the third transistor, the fourth transistor, the first test transistor, the second test transistor, and the third test transistor are all N-type transistors or P-type transistors.

Optionally, a size of the first test transistor, a size of the second test transistor, a size of the third test transistor and a size of the third transistor are all different.

Optionally, the first test signal line, the second test signal line, the third test signal line, or the fourth test signal line receives a control signal or a ground signal.

Optionally, the inverter is capable of being examined in various size arrangements through controlling the control signal received by the first test signal line, the second test signal line, the third test signal line, and the fourth test signal line.

Optionally, the inverter is manufactured by a single mask.

According to an embodiment of the present disclosure, a GOA circuit is disclosed. The GOA circuit comprises an inverter. The GOA circuit comprises a pull-up node. The inverter comprises a first transistor, a second transistor, a third transistor, a fourth transistor, a first test transistor, a second test transistor, and a third test transistor. A gate of the first transistor, a source of the first transistor and a source of the third transistor are electrically connected to a first test signal line. A drain of the first transistor, a drain of the second transistor, and a gate of the third transistor are electrically connected to a first node. A gate of the second transistor and a gate of the fourth transistor are electrically connected to the pull-up node. A source of the second transistor and a source of the fourth transistor are electrically connected to a constant low voltage signal. A drain of the third transistor and a drain of the fourth transistor are electrically connected to a second node. A gate of the first test transistor, a gate of the second test transistor and a gate of the third test transistor are electrically connected to the first node. A drain of the first test transistor, a drain of the second test transistor and a drain of the third test transistor are electrically connected to the second node. A source of the first test transistor is electrically connected to a second test signal line, a source of the second test transistor is electrically connected to a third test signal line, and a source of the third test transistor is electrically connected to a fourth test signal line.

Optionally, the first transistor, the second transistor, the third transistor, the fourth transistor, the first test transistor, the second test transistor, and the third test transistor are all low temperature poly-silicon (LTPS) thin film transistors (TFTs), oxide semiconductor TFTs, or amorphous TFTs.

Optionally, the first transistor, the second transistor, the third transistor, the fourth transistor, the first test transistor, the second test transistor, and the third test transistor are all a same type of transistors.

Optionally, the first transistor, the second transistor, the third transistor, the fourth transistor, the first test transistor, the second test transistor, and the third test transistor are all N-type transistors or P-type transistors.

Optionally, a size of the first test transistor, a size of the second test transistor, a size of the third test transistor and a size of the third transistor are all different.

Optionally, the first test signal line, the second test signal line, the third test signal line, or the fourth test signal line receives a control signal or a ground signal.

Optionally, the inverter is capable of being examined in various size arrangements through controlling the control signal received by the first test signal line, the second test signal line, the third test signal line, and the fourth test signal line.

According to an embodiment of the present disclosure, a display panel is disclosed. The display panel comprises a GOA circuit, which comprises an inverter. The GOA circuit comprises a pull-up node. The inverter comprises a first transistor, a second transistor, a third transistor, a fourth transistor, a first test transistor, a second test transistor, and a third test transistor. A gate of the first transistor, a source of the first transistor and a source of the third transistor are electrically connected to a first test signal line. A drain of the first transistor, a drain of the second transistor, and a gate of the third transistor are electrically connected to a first node. A gate of the second transistor and a gate of the fourth transistor are electrically connected to the pull-up node. A source of the second transistor and a source of the fourth transistor are electrically connected to a constant low voltage signal. A drain of the third transistor and a drain of the fourth transistor are electrically connected to a second node. A gate of the first test transistor, a gate of the second test transistor and a gate of the third test transistor are electrically connected to the first node. A drain of the first test transistor, a drain of the second test transistor and a drain of the third test transistor are electrically connected to the second node. A source of the first test transistor is electrically connected to a second test signal line, a source of the second test transistor is electrically connected to a third test signal line, and a source of the third test transistor is electrically connected to a fourth test signal line.

Optionally, the first transistor, the second transistor, the third transistor, the fourth transistor, the first test transistor, the second test transistor, and the third test transistor are all low temperature poly-silicon (LTPS) thin film transistors (TFTs), oxide semiconductor TFTs, or amorphous TFTs.

Optionally, the first transistor, the second transistor, the third transistor, the fourth transistor, the first test transistor, the second test transistor, and the third test transistor are all a same type of transistors.

Optionally, the first transistor, the second transistor, the third transistor, the fourth transistor, the first test transistor, the second test transistor, and the third test transistor are all N-type transistors or P-type transistors.

Optionally, a size of the first test transistor, a size of the second test transistor, a size of the third test transistor and a size of the third transistor are all different.

In contrast to the conventional art, the inverter of an embodiment comprises a first test transistor, a second test transistor and a third test transistor. Through controlling the conductivities of the first test transistor, the second test transistor and the third test transistor, different inverter arrangements could be realized. In this way, the examination cost could be reduced.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION OF PREFERRED EMBODIMENTS

To help a person skilled in the art better understand the solutions of the present disclosure, the following clearly and completely describes the technical solutions in the embodiments of the present disclosure with reference to the accompanying drawings in the embodiments of the present disclosure. Apparently, the described embodiments are a part rather than all of the embodiments of the present disclosure. All other embodiments obtained by a person of ordinary skill in the art based on the embodiments of the present disclosure without creative efforts shall fall within the protection scope of the present disclosure.

In addition, the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

Figure 1:
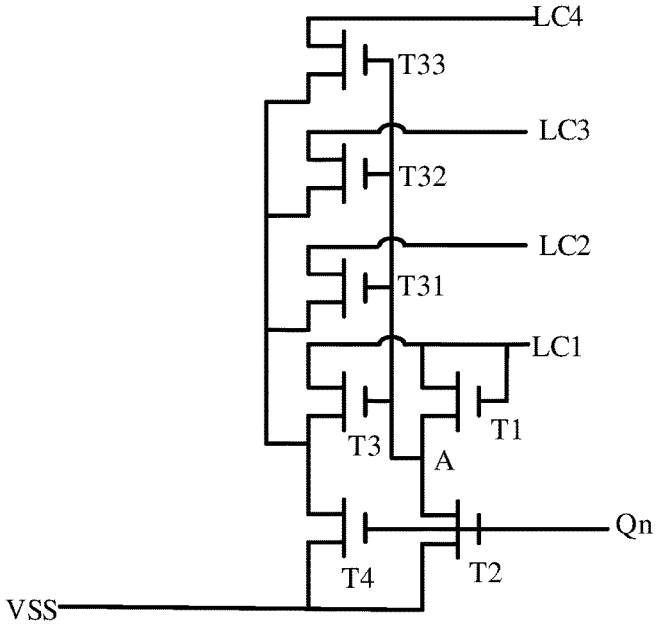
FIG. 1 is a diagram of an equivalent circuit of an inverter according to an embodiment of the present disclosure.

Please refer to FIG. 1. FIG. 1 is a diagram of an equivalent circuit of an inverter according to an embodiment of the present disclosure. The inverter comprises: a first transistor T1, a second transistor T2, a third transistor T3, a fourth transistor T4, a first test transistor T31, a second test transistor T32 and a third test transistor T32. The gate of the first transistor T1, the source of the first transistor T1 and the source of the third transistor T3 are all electrically connected to the first test signal line LC1. The drain of the first transistor T1, the drain of the second transistor T2 and the gate of the third transistor T3 are all electrically connected to the first node A. The gate of the second transistor T2 and the gate of the fourth transistor T4 are both electrically connected to the pull-up node Qn. The source of the second transistor T2 and the source of the fourth transistor T4 are both electrically connected to a constant low voltage signal Vss. The drain of the third transistor T3 and the drain of the fourth transistor T4 are both electrically connected to the second node B.

The gate of the first test transistor T31, the gate of the second test transistor T32 and the gate of the third test transistor T33 are all electrically connected to the first node A. The drain of the first test transistor T31, the drain of the second test transistor T32 and the drain of the third test transistor T33 are all electrically connected to the second node B. The source of the first test transistor T31 is electrically connected to the second test signal line LC2. The source of the second test transistor T32 is electrically connected to the third test signal line LC3. The source of the third test transistor T33 is electrically connected to the fourth test signal line LC4.

The first transistor T1, the second transistor T2, the third transistor T3, the fourth transistor T4, the first test transistor T31, the second test transistor T32, and the third test transistor T33 are all low temperature poly-silicon (LTPS) thin film transistors (TFTs), oxide semiconductor TFTs, or amorphous TFTs.

The first transistor T1, the second transistor T2, the third transistor T3, the fourth transistor T4, the first test transistor T31, the second test transistor T32, and the third test transistor T33 are all the same type of transistors.

The first transistor T1, the second transistor T2, the third transistor T3, the fourth transistor T4, the first test transistor T31, the second test transistor T32, and the third test transistor T33 are all N-type transistors or P-type transistors.

In this embodiment, the transistors in the inverter are all the same type of transistors. Therefore, the influences due to the difference between the transistors could be avoided.

The size of the first test transistor T31, the size of the second test transistor T32, the size of the third test transistor T33 and the size of the third transistor T3 are all different. In other words, through setting the size of the first test transistor T31, the size of the second test transistor T32, the size of the third test transistor T33 and the size of the third transistor T3, the inverter could have different size arrangements.

The first test signal line LC1, the second test signal line LC2, the third test signal line LC3, or the fourth test signal line LC4 receives a control signal or a ground signal. In other words, different size arrangements of an inverter could be realized by selecting one of the control signal and the ground signal to apply to the first test signal line LC1, selecting one of the control signal and the ground signal to apply to the second test signal line LC2, selecting one of the control signal and the ground signal to apply to the third test signal line LC3, and selecting one of the control signal and the ground signal to apply to the fourth test signal line LC4. In this way, different size arrangements of an inverter could be then examined.

In addition, the inverter is manufactured by a single mask. This means that the examinations on different size arrangements of the inverter only require one single mask and the cost is enormously reduced.

In the following disclosure, the examination on the inverter will be illustrated. When a specific size arrangement of the inverter is to be examined, for example, when the ratio of the third transistor T3 to the fourth transistor T4 is: X3L/YL=X3/Y, the ground signal is applied to the first test signal line LC1, the second test signal line LC2 and the third test signal line LC3 and the control signal is applied to the fourth test signal line LC4. Other size arrangements of the inverter, such as X/Y, X1/Y and X2/Y, could be examined in a similar way. In addition, when the size arrangement (X+X1)/Y of the inverter is to be examined, the control signal is applied to the first test signal line LC1 and the second test signal line LC2 and the ground signal is applied to the third test signal line LC3 and the fourth test signal line LC4. From the above, it can be understood that this design could have 15 different size arrangements: X/Y, X1/Y, X2/Y, X3/Y, (X+X1)/Y, (X+X2)/Y, (X+X3)/Y, (X1+X2)/Y, (X1+X3)/Y, (X2+X3)/Y, (X+X1+X2)/Y, (X+X1+X3)/Y, (X+X2+X3)/Y, (X1+X2+X3)/Y and (X+X1+X2+X3)/Y. In other words, this design could examine 15 different size arrangements of the inverter, which is manufactured by only one mask. This does not need to change the mask design and reduce the cost.

Figure 2:
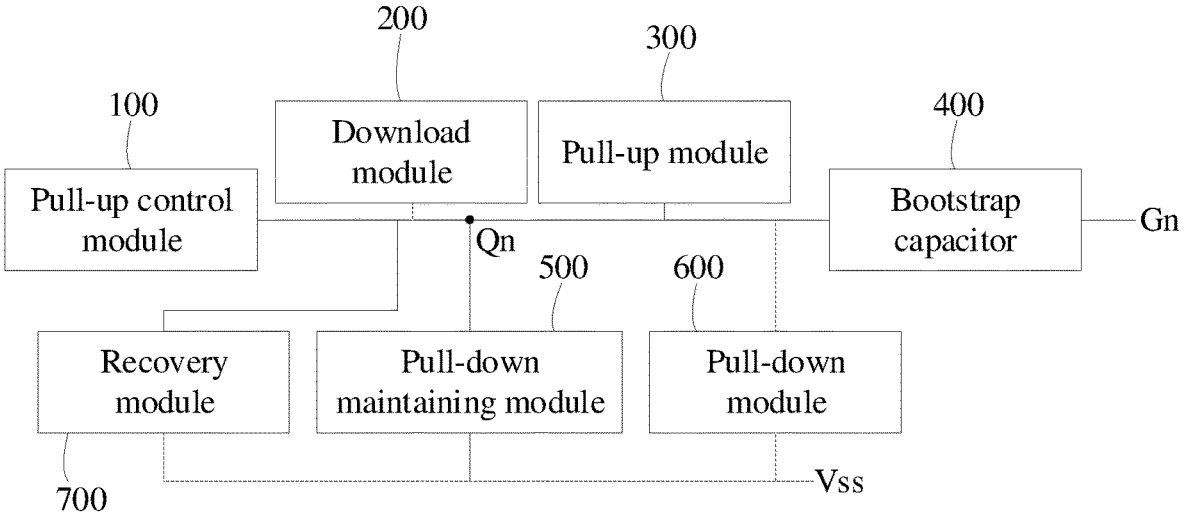
FIG. 2 is a diagram of a structure of a GOA circuit according to an embodiment of the present disclosure.
Figure 3:
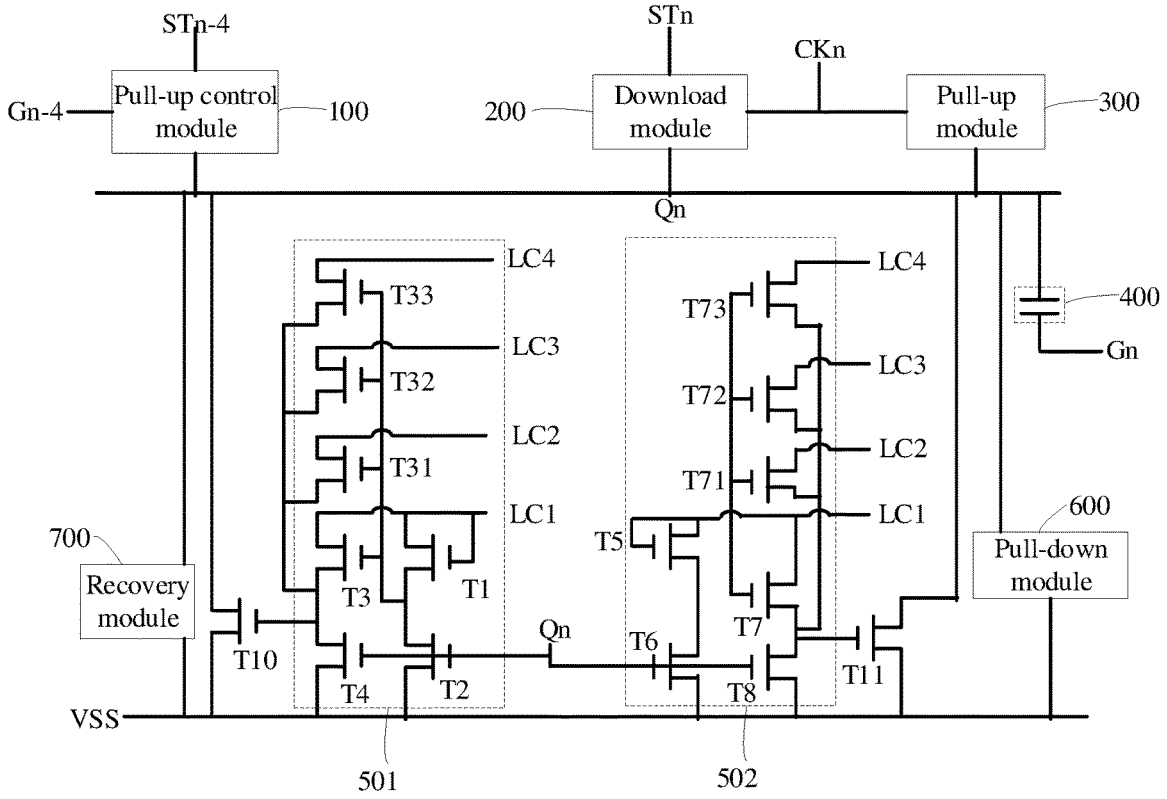
FIG. 3 is a diagram of a GOA circuit according to an embodiment of the present disclosure.

Please refer to FIG. 2 and FIG. 3. FIG. 2 is a diagram of a structure of a GOA circuit according to an embodiment of the present disclosure. FIG. 3 is a diagram of a GOA circuit according to an embodiment of the present disclosure. The GOA circuit comprises series-connected GOA units. Each of the GOA units comprises: a pull-up control module 100, a download module 200, a pull-up module 300, a pull-down module 600, a pull-down maintaining module 500, a bootstrap capacitor 400 and a recovery module 700. The pull-up control module 100, the download module 200, the pull-up module 300, the pull-down module 600, the pull-down maintaining module 500, the bootstrap capacitor 400 and the recovery module 700 are all electrically connected to the pull-up node Qn.

The pull-up control module 100, the download module 200, the pull-up module 300, the pull-down module 600, the bootstrap capacitor 400 are implemented with transistors and could be understood by one having ordinary skills in the art and thus further illustration is omitted here.

Figure 4:
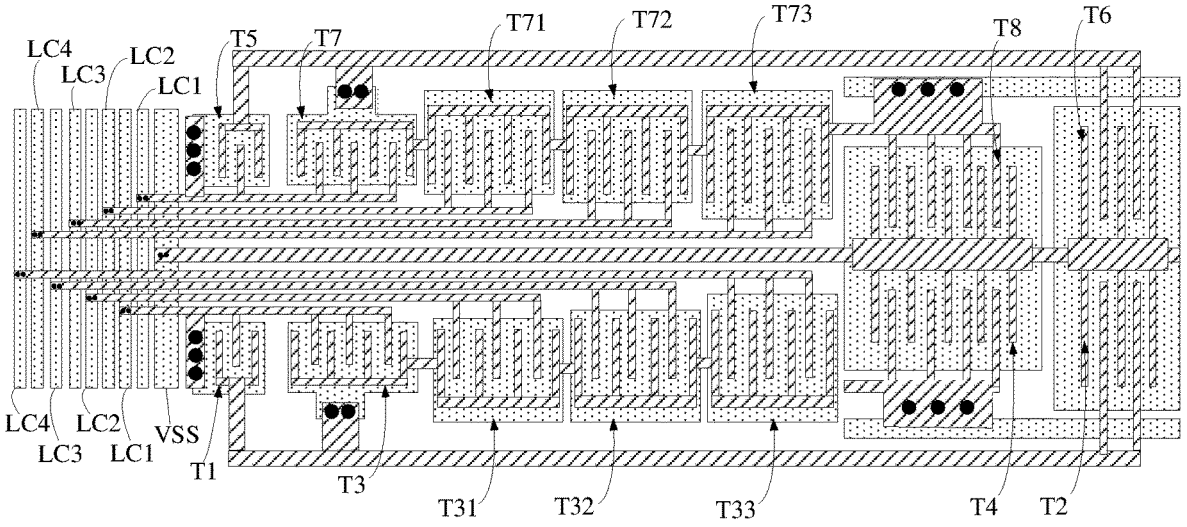
FIG. 4 is a diagram of an inverter of the GOA circuit shown in FIG. 3.

Please refer to FIG. 1 to FIG. 4. FIG. 4 is a diagram of an inverter of the GOA circuit shown in FIG. 3. The pull-down maintaining module 500 comprises the first inverter 501, the second inverter 502, the tenth TFT T10 and the eleventh TFT T11. The structures of the first inverter 501 and the second inverter 502 are similar to the structure of the inverter of the previous embodiment.

The difference between the first inverter 501 and the second inverter 502 is: The signal applied to the first test signal line LC1, the second test signal line LC2, the third test signal line LC3 and the fourth test signal line LC4 in the first inverter 501 has reversed phase of the signal applied to the first test signal line LC1, the second test signal line LC2, the third test signal line LC3 and the fourth test signal line LC4 in the second inverter 502.

The transistors in the first inverter 501 correspond to the transistors in the inverter shown in FIG. 1. In the second inverter 502, the transistor T5 corresponds to the transistor T1 shown in FIG. 1, the transistor T7 corresponds to the transistor T3 shown in FIG. 1, the transistor T8 corresponds to the transistor T4 shown in FIG. 1, the transistor T71 corresponds to the transistor T31 shown in FIG. 1, the transistor T72 corresponds to the transistor T32 shown in FIG. 1, and the transistor T73 corresponds to the transistor T33 shown in FIG. 1

The mechanism for examining different size arrangements of the first inverter 501 and the second inverter 502 is similar to that of the previous embodiment and thus further illustration is omitted here.

In the inverter, GOA circuit and a display panel according to an embodiment of the present disclosure, the inverter comprises a first test transistor, a second test transistor and a third test transistor. Through controlling the conductivities of the first test transistor, the second test transistor and the third test transistor, different inverter arrangements could be realized. In this way, the examination cost could be reduced.

In addition, according to an embodiment of the present disclosure, a display panel is disclosed. The display panel comprises the above-mentioned GOA circuit and further details are omitted here.

Above are embodiments of the present disclosure, which does not limit the scope of the present disclosure. Any modifications, equivalent replacements or improvements within the spirit and principles of the embodiment described above should be covered by the protected scope of the invention.

What is claimed is:

1. An inverter, used in a gate driver on array (GOA) circuit, the GOA circuit having a pull-up node, the inverter comprising:

a first transistor;

a second transistor;

a third transistor;

a fourth transistor;

a first test transistor;

a second test transistor; and a third test transistor;

wherein a gate of the first transistor, a source of the first transistor and a source of the third transistor are electrically connected to a first test signal line, a drain of the first transistor, a drain of the second transistor, and a gate of the third transistor are electrically connected to a first node, a gate of the second transistor and a gate of the fourth transistor are electrically connected to the pull-up node, a source of the second transistor and a source of the fourth transistor are electrically connected to a constant low voltage signal, and a drain of the third transistor and a drain of the fourth transistor are electrically connected to a second node;

wherein a gate of the first test transistor, a gate of the second test transistor and a gate of the third test transistor are electrically connected to the first node, a drain of the first test transistor, a drain of the second test transistor and a drain of the third test transistor are electrically connected to the second node, a source of the first test transistor is electrically connected to a second test signal line, a source of the second test transistor is electrically connected to a third test signal line, and a source of the third test transistor is electrically connected to a fourth test signal line;

wherein the first test signal line, the second test signal line, the third test signal line, or the fourth test signal line receives a control signal or a ground signal; and wherein the inverter is capable of being examined in various size arrangements through controlling the control signal received by the first test signal line, the second test signal line, the third test signal line, and the fourth test signal line.

2. The inverter of claim 1, wherein the first transistor, the second transistor, the third transistor, the fourth transistor, the first test transistor, the second test transistor, and the third test transistor are all low temperature poly-silicon (LTPS) thin film transistors (TFTs), oxide semiconductor TFTs, or amorphous TFTs.

3. The inverter of claim 2, wherein the first transistor, the second transistor, the third transistor, the fourth transistor, the first test transistor, the second test transistor, and the third test transistor are all a same type of transistors.

4. The inverter of claim 3, wherein the first transistor, the second transistor, the third transistor, the fourth transistor, the first test transistor, the second test transistor, and the third test transistor are all N-type transistors or P-type transistors.

5. The inverter of claim 1, wherein a size of the first test transistor, a size of the second test transistor, a size of the third test transistor and a size of the third transistor are all different.

6. The inverter of claim 1, wherein the inverter is manufactured by a single mask.

7. A gate driver on array (GOA) circuit having a pull-up node, comprising an inverter, the inverter comprising:

a first transistor;

a second transistor;

a third transistor;

a fourth transistor;

a first test transistor;

a second test transistor; and a third test transistor;

wherein a gate of the first transistor, a source of the first transistor and a source of the third transistor are electrically connected to a first test signal line, a drain of the first transistor, a drain of the second transistor, and a gate of the third transistor are electrically connected to a first node, a gate of the second transistor and a gate of the fourth transistor are electrically connected to the pull-up node, a source of the second transistor and a source of the fourth transistor are electrically connected to a constant low voltage signal, and a drain of the third transistor and a drain of the fourth transistor are electrically connected to a second node;

wherein a gate of the first test transistor, a gate of the second test transistor and a gate of the third test transistor are electrically connected to the first node, a drain of the first test transistor, a drain of the second test transistor and a drain of the third test transistor are electrically connected to the second node, a source of the first test transistor is electrically connected to a second test signal line, a source of the second test transistor is electrically connected to a third test signal line, and a source of the third test transistor is electrically connected to a fourth test signal line;

wherein the first test signal line, the second test signal line, the third test signal line, or the fourth test signal line receives a control signal or a ground signal; and wherein the inverter is capable of being examined in various size arrangements through controlling the control signal received by the first test signal line, the second test signal line, the third test signal line, and the fourth test signal line.

8. The GOA circuit of claim 7, wherein the first transistor, the second transistor, the third transistor, the fourth transistor, the first test transistor, the second test transistor, and the third test transistor are all low temperature poly-silicon (LTPS) thin film transistors (TFTs), oxide semiconductor TFTs, or amorphous TFTs.

9. The GOA circuit of claim 8, wherein the first transistor, the second transistor, the third transistor, the fourth transistor, the first test transistor, the second test transistor, and the third test transistor are all a same type of transistors.

10. The GOA circuit of claim 9, wherein the first transistor, the second transistor, the third transistor, the fourth transistor, the first test transistor, the second test transistor, and the third test transistor are all N-type transistors or P-type transistors.

11. The GOA circuit of claim 7, wherein a size of the first test transistor, a size of the second test transistor, a size of the third test transistor and a size of the third transistor are all different.

12. A display panel, comprising a GOA circuit having an inverter, the GOA circuit having a pull-up node, the inverter comprising:

a first transistor;

a second transistor;

a third transistor;

a fourth transistor;

a first test transistor;

a second test transistor; and a third test transistor;

wherein a gate of the first transistor, a source of the first transistor and a source of the third transistor are electrically connected to a first test signal line, a drain of the first transistor, a drain of the second transistor, and a gate of the third transistor are electrically connected to a first node, a gate of the second transistor and a gate of the fourth transistor are electrically connected to the pull-up node, a source of the second transistor and a source of the fourth transistor are electrically connected to a constant low voltage signal, and a drain of the third transistor and a drain of the fourth transistor are electrically connected to a second node;

wherein a gate of the first test transistor, a gate of the second test transistor and a gate of the third test transistor are electrically connected to the first node, a drain of the first test transistor, a drain of the second test transistor and a drain of the third test transistor are electrically connected to the second node, a source of the first test transistor is electrically connected to a second test signal line, a source of the second test transistor is electrically connected to a third test signal line, and a source of the third test transistor is electrically connected to a fourth test signal line;

wherein the first test signal line, the second test signal line, the third test signal line, or the fourth test signal line receives a control signal or a ground signal; and wherein the inverter is capable of being examined in various size arrangements through controlling the control signal received by the first test signal line, the second test signal line, the third test signal line, and the fourth test signal line.

13. The display panel of claim 12, wherein the first transistor, the second transistor, the third transistor, the fourth transistor, the first test transistor, the second test transistor, and the third test transistor are all low temperature poly-silicon (LTPS) thin film transistors (TFTs), oxide semiconductor TFTs, or amorphous TFTs.

14. The display panel of claim 13, wherein the first transistor, the second transistor, the third transistor, the fourth transistor, the first test transistor, the second test transistor, and the third test transistor are all a same type of transistors.

15. The display panel of claim 14, wherein the first transistor, the second transistor, the third transistor, the fourth transistor, the first test transistor, the second test transistor, and the third test transistor are all N-type transistors or P-type transistors.

16. The display panel of claim 12, wherein a size of the first test transistor, a size of the second test transistor, a size of the third test transistor and a size of the third transistor are all different.

* * * * *